US008087421B2

(12) United States Patent
Gorey et al.

(10) Patent No.: US 8,087,421 B2
(45) Date of Patent: Jan. 3, 2012

(54) ILLUMINATED APPARATUS FOR ASSISTING MOVEMENT

(75) Inventors: Michael James Gorey, Arlington Heights, IL (US); Scott William Schultz, Raleigh, NC (US)

(73) Assignee: 3D Relief, Inc., Raleigh, NC (US)

( * ) Notice: Subject to any disclaimer, the term of this patent is extended or adjusted under 35 U.S.C. 154(b) by 0 days.

(21) Appl. No.: 12/641,866

(22) Filed: Dec. 18, 2009

(65) Prior Publication Data

US 2010/0154851 A1 Jun. 24, 2010

Related U.S. Application Data

(60) Provisional application No. 61/139,616, filed on Dec. 21, 2008.

(51) Int. Cl.
*A45B 3/02* (2006.01)
*A45B 3/04* (2006.01)

(52) U.S. Cl. ..... 135/66; 135/65; 135/910

(58) Field of Classification Search ..... 135/65, 135/66, 910; 362/102
See application file for complete search history.

(56) References Cited

U.S. PATENT DOCUMENTS

| | | | | |
|---|---|---|---|---|
| 331,095 | A * | 11/1885 | Steinberger | 135/66 |
| 754,631 | A | 3/1904 | Allen | |
| 2,435,650 | A | 2/1948 | Greene | |
| 2,478,325 | A | 8/1949 | Russell | |
| D207,764 | S | 5/1967 | Lozo et al. | |
| 3,336,469 | A | 8/1967 | Barnes, Sr. et al. | |
| 4,013,881 | A | 3/1977 | Sargent | |
| 4,099,535 | A | 7/1978 | Hubachek | |
| 4,206,445 | A | 6/1980 | Steinhauer | |
| 4,278,274 | A * | 7/1981 | Ray | 280/821 |
| 4,562,850 | A | 1/1986 | Earley et al. | |
| 4,583,080 | A | 4/1986 | DiVito et al. | |
| D286,271 | S | 10/1986 | Buch | |
| 4,625,742 | A | 12/1986 | Phillips | |
| 4,837,666 | A | 6/1989 | Conkle | |
| 5,056,821 | A | 10/1991 | Fierro | |
| 5,226,718 | A | 7/1993 | Lin | |
| 5,271,640 | A | 12/1993 | Potochick et al. | |
| 5,295,057 | A | 3/1994 | Buosante et al. | |
| 5,331,990 | A | 7/1994 | Hall et al. | |
| 5,351,704 | A | 10/1994 | Hunnicutt, Jr. et al. | |
| 5,392,800 | A | 2/1995 | Sergi | |
| 5,582,196 | A | 12/1996 | Hae et al. | |
| 5,588,735 | A | 12/1996 | Harada | |

(Continued)

OTHER PUBLICATIONS

International Search Report for corresponding International Application No. PCT/US2009/068739 dated Apr. 23, 2010.

*Primary Examiner* — David Dunn
*Assistant Examiner* — Danielle Jackson
(74) *Attorney, Agent, or Firm* — McDonnell Boehnen Hulbert & Berghoff LLP

(57) ABSTRACT

An illuminated apparatus for assisting movement is provided that is able to illuminate surface areas upon which one walks, hikes, skis, skates, runs, reads from, signals, examines or studies. The illuminated apparatus for assisting movement may provide both broad and focused illumination. The device may ensure safe footing, solid purchase, and stable load bearing by providing illuminated assistance for foot, ski and skate placement, as well as the placement of singular and multi-pole fixtures used for activities such as hiking, climbing, skiing, skating, running, and walking. The illuminated apparatus for assisting movement may be compact and lightweight.

14 Claims, 9 Drawing Sheets

U.S. PATENT DOCUMENTS

| | | | |
|---|---|---|---|
| 5,722,445 | A | 3/1998 | Hae et al. |
| 5,757,597 | A | 5/1998 | Frank, Sr. |
| 5,810,466 | A | 9/1998 | Young |
| 6,711,772 | B2 | 3/2004 | Grassi |
| 6,772,778 | B2 | 8/2004 | Morosini et al. |
| 7,059,738 | B1 | 6/2006 | Nobayashi |
| 7,134,762 | B2 | 11/2006 | Ma |
| 2004/0036578 | A1 | 2/2004 | Preston |
| 2006/0090783 | A1 | 5/2006 | King-Fai |
| 2006/0266397 | A1 | 11/2006 | Berl |
| 2008/0251109 | A1* | 10/2008 | Lee ..... 135/66 |
| 2008/0304254 | A1 | 12/2008 | Canino et al. |

* cited by examiner

ILLUMINATED APPARATUS FOR ASSISTING MOVEMENT

CROSS-REFERENCE TO RELATED APPLICATIONS

This application claims priority to provisional application Ser. No. 61/139,616 filed on Dec. 21, 2008, which is herein incorporated by reference in its entirety.

BACKGROUND

1. Field of the Application

The present application relates generally to a walking aid or other human-powered locomotion and stabilization aid having an illumination source. The walking aid may be used by individuals in recreational activities, as well as by physically challenged individuals engaged in their daily activities. The illuminated walking aid may facilitate moving more safely from one place to another where an individual or group would benefit from seeing the floor, ground, or other surface more clearly, or by being seen more easily by others.

2. Description of the Related Art

Recreational hiking poles and ski poles assist hikers, skiers, skaters, mountain climbers, and search and rescue teams when they need to stabilize themselves and their footing while engaged in such activities. Canes, walkers, crutches, and walking carts similarly provide physically challenged persons and people with physical disabilities with needed stability when moving from one place to another. The value of canes, walkers, hiking poles and similar devices in assisting individuals desiring greater stability correlates directly with how well the ends or tips of the poles, canes, etc. connect with the ground to achieve the desired and required weight-bearing traction and support. When compromised or deficient lighting or visibility conditions exist, whether outside in twilight, at night, or in overcast, rainy or snowy conditions, or when inside where lighting conditions may be poor, it is more difficult to ensure the necessary stable footing from the placement of the walking aid pole or cane base to achieve the required or desired safe traction and load-bearing stability.

Some prior art walking aids have illumination sources designed into the handles of walking sticks which, by their nature, are not capable of supporting the loads that hikers, backpackers, and skiers put on the handles of poles used for these purposes. These designs are also not capable of supporting the requirement to reach above a user's head for proper placement of, for example, a pole tip when climbing or below the user's waist when pushing off and stepping up or skiing down an incline.

Further, prior art walking aids do not provide circumferential lighting to illuminate areas to the sides of and behind the canes or hiking poles. Since these prior devices do not provide illumination to the sides and behind where a walking, hiking, or skiing aid might be placed, they are not suitable for moving over the uneven terrain commonly encountered when hiking, climbing or skiing. Without such illumination, these walking aids do not allow users to accurately place the pole tips where they will provide the required stability and traction, nor do they provide for proper foot placement, making them ill-suited for the purposes described above.

These as well as other aspects and advantages will become apparent to those of ordinary skill in the art by reading the following detailed description, with reference where appropriate to the accompanying drawings. Further, it should be understood that the embodiments described in this summary and elsewhere are intended to illustrate the invention by way of example only.

SUMMARY

The present application provides an apparatus for assisting movement having a generally elongated shaft that includes a first end on which a handle oriented along the generally elongated shaft is disposed and a second end for contacting a walking surface. The handle has a first end and a second end and the first end has a removable portion. The handle further includes at least one light source located adjacent to the second end of the handle, and at least one power source located within the handle for powering the at least one light source. In one embodiment, the at least one power source is disposed perpendicular to the orientation of the handle along the generally elongated shaft. In another embodiment, the at least one power source is disposed parallel to the orientation of the handle along the generally elongated shaft.

In another embodiment, a detachable light source for attachment to an apparatus for assisting movement is provided. The detachable light source includes a housing configured to accommodate at least one power source, at least one light source located within the housing, the at least one light source being powered by the at least one power source, and a clamping mechanism for removably securing the housing to the apparatus for assisting movement. The clamping mechanism includes a back plate having an aperture that receives an outwardly extending member, which is connected to an adjustment knob for securing the clamping mechanism to the pole.

In yet another embodiment, a handle for attachment to a generally elongated shaft of an apparatus for assisting movement is provided. The handle is oriented along the generally elongated shaft and includes a first end and a second end, the first end having a removable portion, at least one light source located within the handle, and at least one power source located within the handle for powering the at least one light source.

BRIEF DESCRIPTION OF THE DRAWINGS

Exemplary embodiments of the invention are described herein with reference to the drawings, in which.

DETAILED DESCRIPTION

Figure 1:
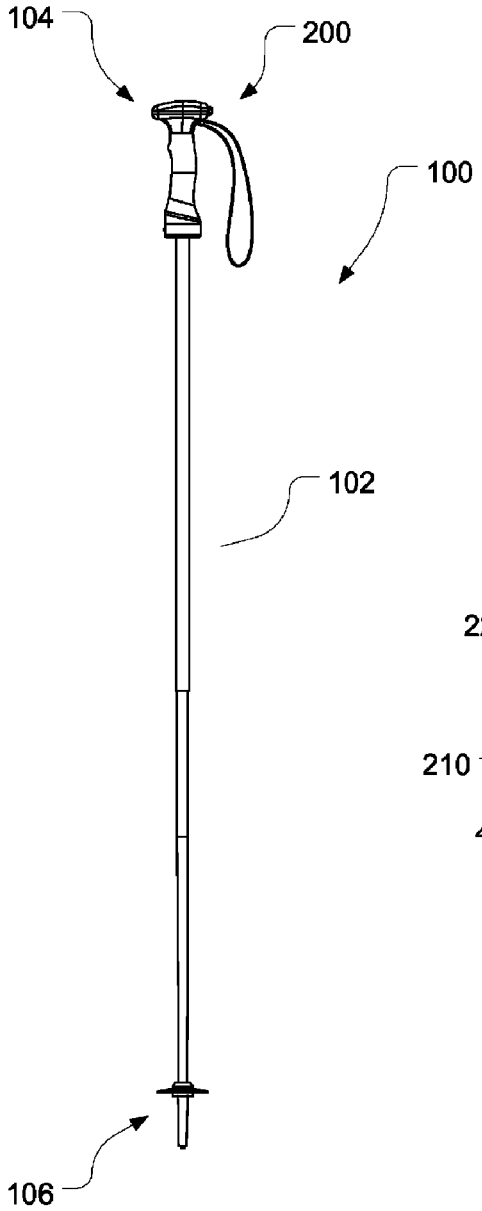
FIG. 1 is a side view of an apparatus for assisting movement of the present application.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

The present application provides an illuminated apparatus for assisting movement, such as a walking aid, which provides light in a downward direction toward the feet of a user. The walking aid may be used for recreational pursuits, search and rescue activities, or physically challenged ambulatory movement. The walking aid allows the user to clearly see where their feet, skis, skates, and crampons and the tips of their walking, skiing and skating poles, canes or walkers should be placed so that the necessary load-bearing stability assistance results are achieved when lighting and visibility conditions are less than optimal. The walking aid may also be used as a signaling device, for example.

The illuminated walking aid of the present application provides users with all forms of helpful features exemplified by a streamlined, weatherproof, and waterproof molded enclosure that is impervious to the challenging conditions to which it may be exposed. The illuminated walking aid further includes illumination sources that are adjustable from both directional and lighting intensity perspectives, as well as rechargeable and disposable battery power source flexibility. The streamlined and rugged embodiments are designed to easily shed branches and other obstructions as well as being able to easily stand up to other harsh elements commonly encountered during outdoor activities such as backpacking, hiking, mountaineering, and backcountry skiing.

Turning now to the drawings, FIG. 1 shows an exemplary apparatus for assisting movement, such as a walking aid 100, of the present application. As discussed above, the apparatus for assisting movement may be a hiking pole, ski pole, cane, walker, or other stabilizing or balancing device used to make walking, hiking, climbing, skiing, and similar activities safer and more efficient. The walking aid may include a pole 102 having a first end 104 and a second end 106. The pole 102 may include a generally elongated shaft which may have a cylindrical or non-cylindrical cross-section. Pole 102 may also be adjustable in length. In one embodiment, the pole 102 may include a handle 200 secured to the first end 104. The handle 200 may be oriented generally along the elongated shaft, in a direction parallel to a longitudinal axis of the generally elongated shaft, and in a generally vertical direction. In an alternate embodiment, the handle 200 may be oriented in a direction perpendicular to the generally elongated shaft. The handle 200 may be molded to the first end 104, or alternatively, may be secured to the top end by any suitable connection mechanism.

Figure 2:
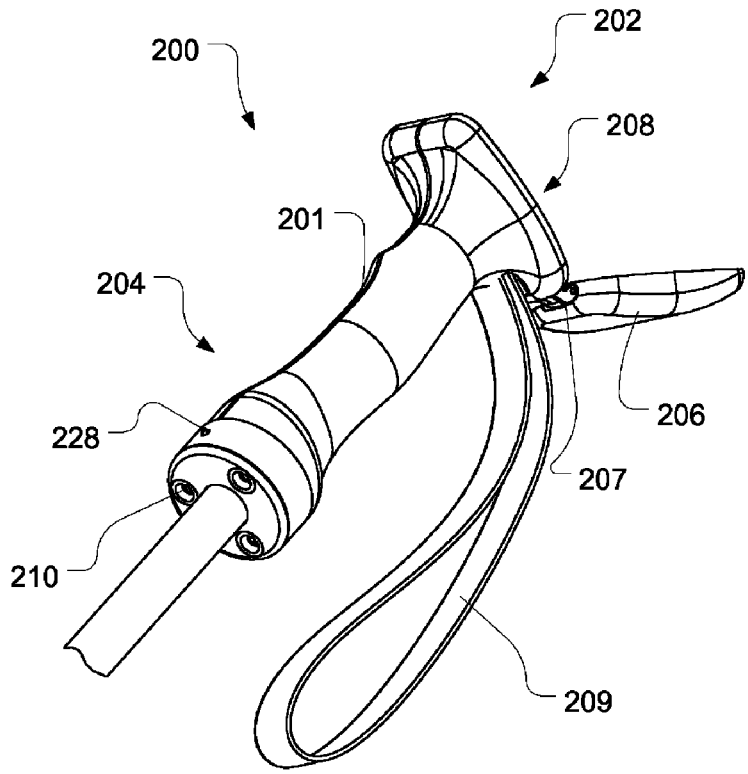
FIG. 2 is a perspective view of the handle of the apparatus for assisting movement shown in FIG. 1.
Figure 3:
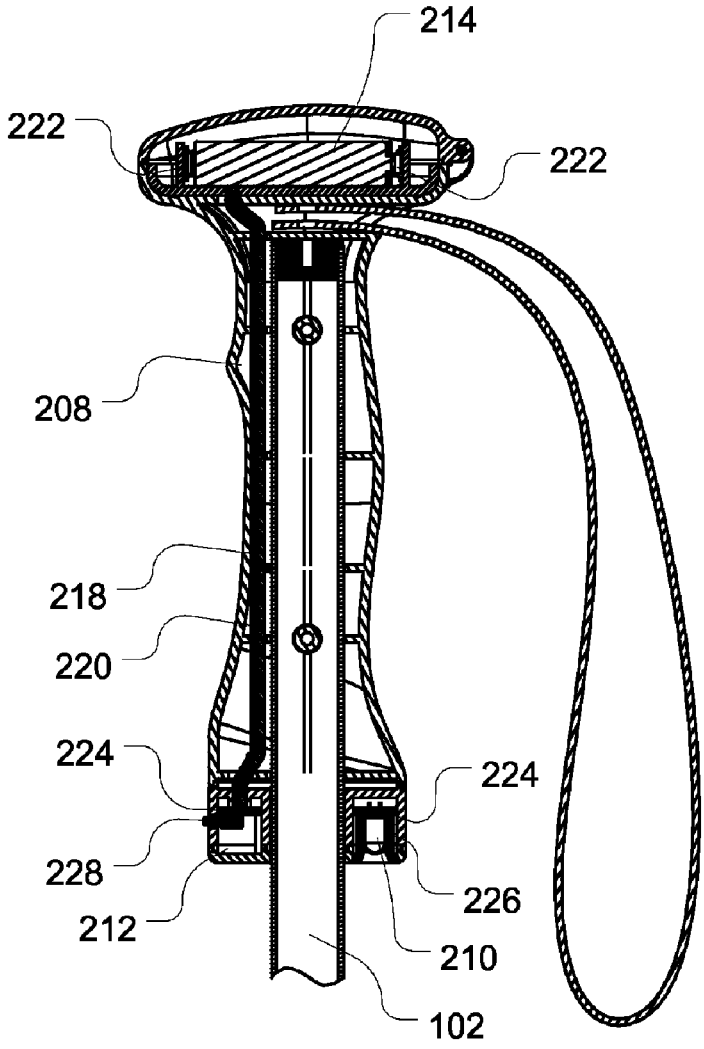
FIG. 3 is a cross-sectional side view of the handle shown in FIG. 2.
Figure 4:
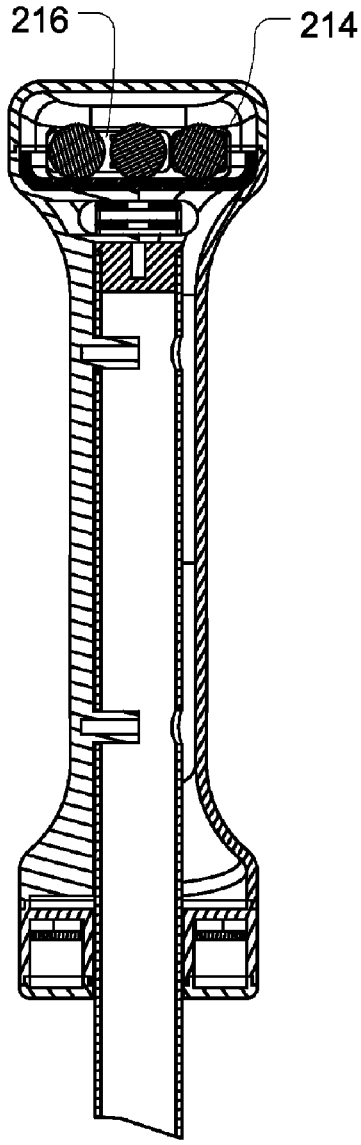
FIG. 4 is a cross-sectional front view of the handle shown in FIG. 2.

Referring to FIG. 2, the handle 200 may include a first end 202 and a second end 204. The first end 202 of the handle 200 may be oriented toward the first end 104 of the pole and the second end 204 of the handle 200 may be oriented toward the second end 106 of the pole 102. The handle 200 may also include a gripping portion 201 which facilitates gripping of the handle by a user. The handle 200 may further include a removable portion 206 at the first end 202. The removable portion 206 may be attached to the first end by a hinge 207, for example. The handle 200 may also include an inner cavity 208, which is best seen in FIGS. 3 and 4, which may accommodate power sources, electronics, and light sources. The removable portion 206 can be closed to seal the inner cavity 208 to protect its contents from the elements. Thus, the handle 200 may be water resistant, and may be constructed of plastic, rubber, or metal, for example. The handle may also include a strap 209 connected to the first end 202 to aid a user in holding onto the handle 200. Alternatively, the strap 209 may be connected anywhere on the handle 200 or pole 102.

The second end 204 of the handle 200 may include at least one light source 210, which may be a light emitting diode (LED), for example. Alternatively, the light source may be any other suitable light source, such as incandescent or fluorescent, for example. In other embodiments, three light sources are included on the handle 200. The light source 210 may be positioned within a light compartment 212 located at the second end 204 of the handle 200 to protect the light source 210. The light source may project downwardly toward any surface on which a user might move, such as the ground, floor, or surface upon which a person would walk, hike, climb, or ski.

As shown in FIGS. 3 and 4, the handle 200 may include at least one power source 214 mounted in a power source compartment 216 in an orientation perpendicular relative to the shaft of the handle. In one embodiment, the power source 214 may include three AAA batteries. In another embodiment, the power source 214 may include one or more rechargeable batteries. Alternatively, the power source may be any suitable energy generating device. The removable portion 206 of the handle allows the power source 214 to be easily loaded or recharged to power the illumination of the light source 210. Both positive and negative wires 218, 220 run from contacts 222 located in the power source compartment 216 down through the inner cavity 208 of the handle 200 to the light compartment 212 which contains the light source 210, a circuit board 224, light source lens 226, and a light switch 228. The light source lens 226 may surround the light source 210 and may diffuse or focus the light. One example of a light source lens 226 is shown in FIG. 3.

The light switch 228 may take any form, including a control switch, a toggle, or a thumbwheel, for example. Pressing on the light switch allows the user to toggle the light between different modes for different lighting conditions, including levels for low, medium, and high brightness, as well as a strobe setting, which are all settings that may be integrated into the circuit board 224. Alternatively, the light switch 228 may be mounted near the first end 202 of the handle under the power source compartment 216, or in the removable portion 206, so that a user may operate the switch with one forefinger or thumb while gripping the handle 200.

The handle 200 may alternatively be configured with directionally controllable light sources (not shown). In this configuration, the light source 210, the light source lens 226, the circuit board 224, and the adjacent portion of the enclosure which houses these components may be mounted on a locking pivot (not shown). By loosening the pivot, adjusting the light direction, and re-tightening the pivot, the light source may be tilted forward or backward to better control the area being illuminated in front of or behind the user.

The handle 200 may further include a "power on" power source indicator light located on the light compartment 212. Alternatively, the power source indicator light may be mounted near the first end 202 of the handle under the power source compartment 216, or in the removable portion 206. Further, the handle 200 may include a remaining power indicator gauge located on the light compartment 212 to alert the user of how much power remains in the power source. Alternatively, the remaining power source indicator gauge may be mounted near the first end 202 of the handle under the power source compartment 216, or in the removable portion 206.

In operation, a user turns the light switch, or other such control, into the "power on" position. The user then may select the desired lighting level. The electronics and circuit board within the device regulate the power to the lights based on how the switch has been set. The light source circumferentially illuminates the floor, ground, or desired surface, and also provides illumination of objects near the pole, including but not limited to the person using the device, to ensure stable footing or placement of skis, skates, crampons, pole and cane tips and ends. Although certain aspects show the light source providing circumferential illumination, other embodiments may include other forms of lighting, such as a spotlight or floodlight, for example.

Figure 5:
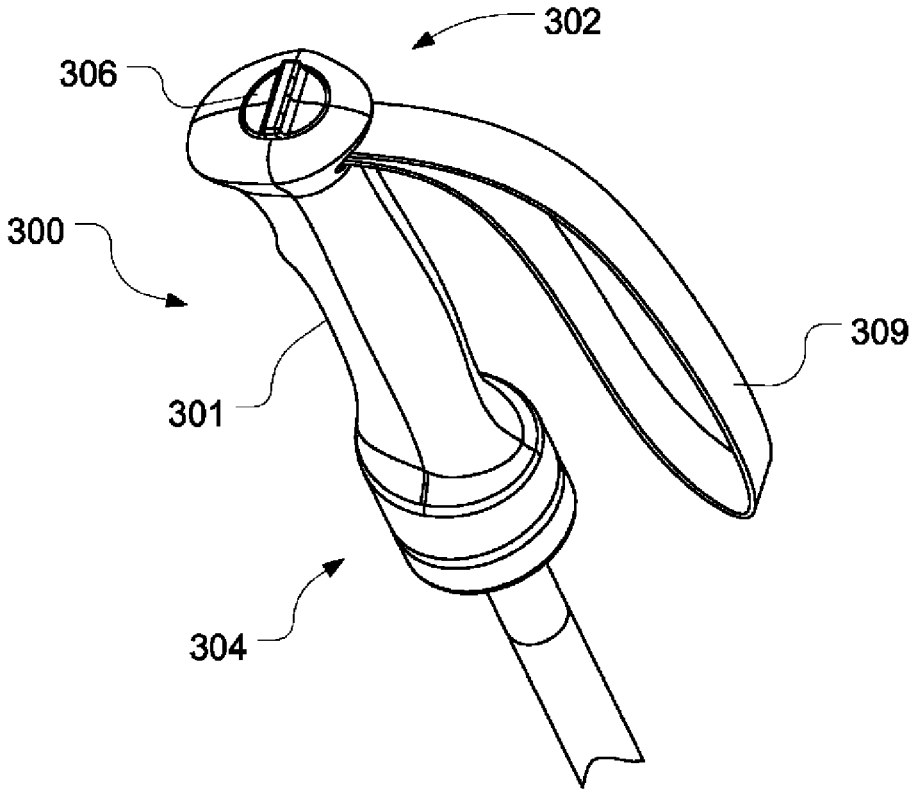
FIG. 5 is a perspective view of an alternate embodiment of a handle of for use with an apparatus for assisting movement, such as the apparatus for assisting movement shown in FIG. 1.
Figure 6:
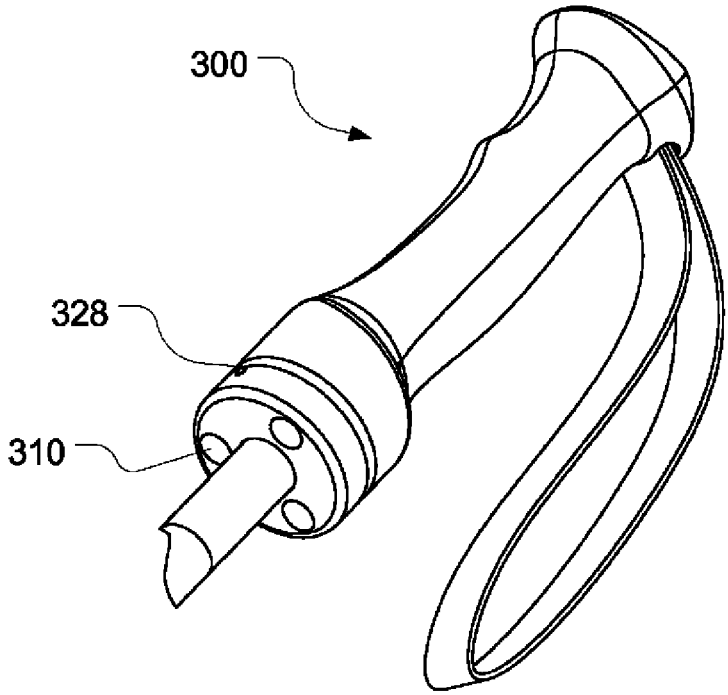
FIG. 6 is a perspective view of the apparatus for assisting movement shown in FIG. 5.
Figure 7:
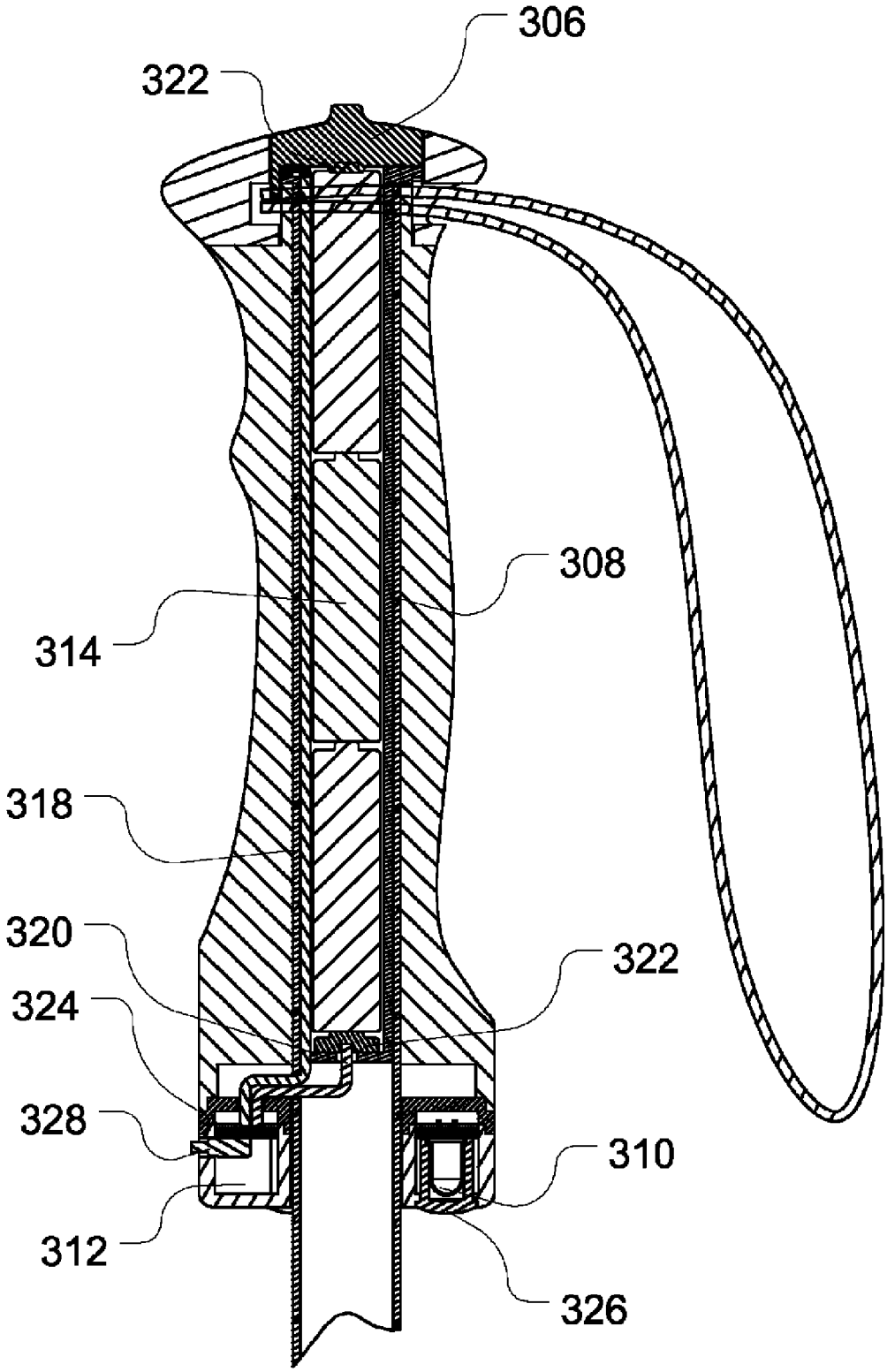
FIG. 7 is a cross-sectional side view of the handle shown in FIG. 5.

FIGS. 5-7 show an alternate embodiment of the handle 300 that may be connected to a walking aid, such as pole 102. In this embodiment, the handle 300 has a first end 302 and a second end 304. The first end 302 of the handle 300 may be oriented toward the first end 104 of the pole and the second end 304 of the handle 300 may be oriented toward the second end 106 of the pole 102. The handle 300 may be oriented generally along the elongated shaft of the pole, in a direction parallel to a longitudinal axis of the generally elongated shaft, and in a generally vertical direction. In an alternate embodiment, the handle 300 may be oriented in a direction perpendicular to the generally elongated shaft. The handle 300 may also include a gripping portion 301 which facilitates gripping of the handle by a user. The handle 300 may further include a removable portion 306 at the first end 302. The removable portion 306 may be attached to the first end by a hinge, strap, or other suitable means (not shown), for example. The handle 300 may also include an inner cavity 308, which is best seen in FIG. 7, which may accommodate power sources, electronics, and light sources. The removable portion 306 can be closed to seal the inner cavity 308 to protect its contents from the elements. Thus, the handle 300 may be water resistant and may be constructed of ABS plastic, rubber, or metal, for example. The handle may also include a strap 309 connected to the first end 302 to aid a user in holding on to the handle 300. Alternatively, the strap 309 may be connected anywhere on the handle 300 or pole 102.

The second end 304 of the handle 300 may include at least one light source 310, which may be a light emitting diode (LED). Alternatively, the light source may be any other suitable light source, such as incandescent or fluorescent, for example. In other embodiments, three light sources are included on the handle 300. The light source 310 may be positioned within a light compartment 312 located at the second end 304 of the handle 300. The light source may project downwardly toward the ground, floor, or surface upon which a person would walk, hike, climb, or ski.

As shown in FIG. 7, the handle 300 may include at least one power source 314 mounted in the inner cavity 308 in a position parallel to the shaft of the handle. In one embodiment, the power source 314 may include three AAA batteries. In another embodiment, the power source 314 may include one or more rechargeable batteries. Alternatively, the power source may be any suitable energy generating device. The removable portion 306 of the handle allows the batteries to be easily loaded or recharged to power the illumination of the light source 310. Both positive and negative wires 318, 320 run from contacts 322 located in the inner cavity of the handle 300 to the light compartment 312, which contains the light source 310, a circuit board 324, a light source lenses 326, and a light switch 328. Pressing on the light switch allows the user to toggle the light between different modes for different lighting conditions, including levels for low, medium, and high brightness, as well as a strobe setting, which are all settings that may be integrated into the circuit board 324. Alternatively, the light switch 328 may be mounted near the first end 302 of the handle so that a user may operate the switch with a forefinger or thumb while gripping the handle 300.

The handle 300 may alternatively be configured with directionally controllable light sources. In this configuration, the light source 310, the light source lens 326, the circuit board 324, and the adjacent portion of the enclosure which houses these components may be mounted on a locking pivot (not shown). By loosening the pivot, adjusting the light direction, and re-tightening the pivot, the light source may be tilted forward or backward to better control the area being illuminated in front of or behind the user.

In operation, a user turns the light switch, or other such control, into the "power on" position. The user then may select the desired lighting level. The electronics and circuit board within the device regulate the power to the lights based on how the switch has been set. The light source circumferentially illuminates the floor, ground, or desired surface, and also provides illumination of objects near the pole, including but not limited to the person using the device, to ensure stable footing or placement of skis, skates, crampons, pole and cane tips and ends.

Figure 8:
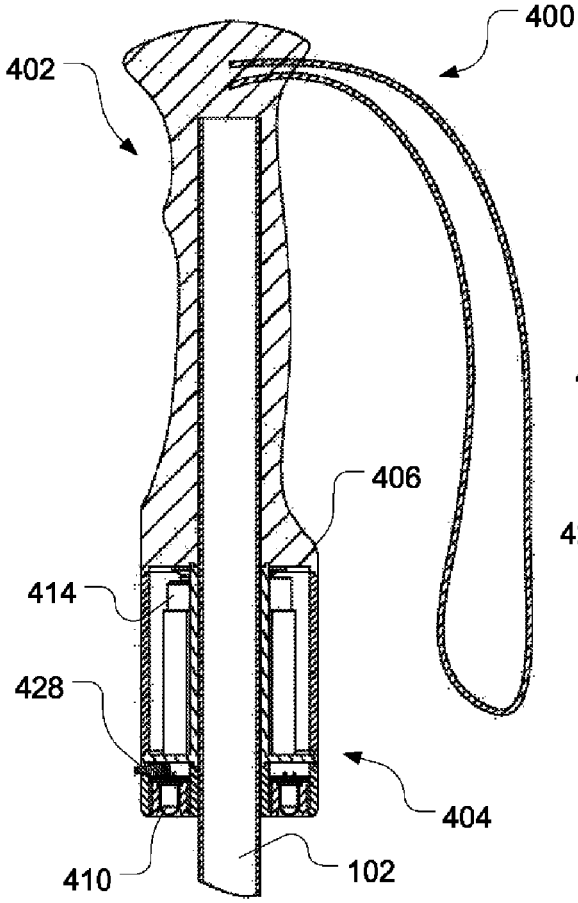
FIG. 8 is a cross-sectional view of another alternate embodiment of a handle of for use with an apparatus for assisting movement, such as the apparatus for assisting movement shown in FIG. 1.
Figure 9:
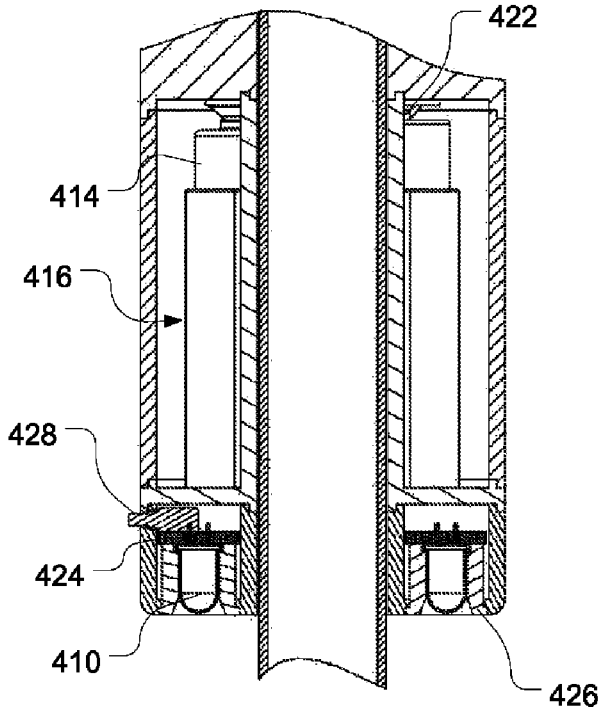
FIG. 9 is a cross-sectional close up view of the handle shown in FIG. 8.
Figure 10:
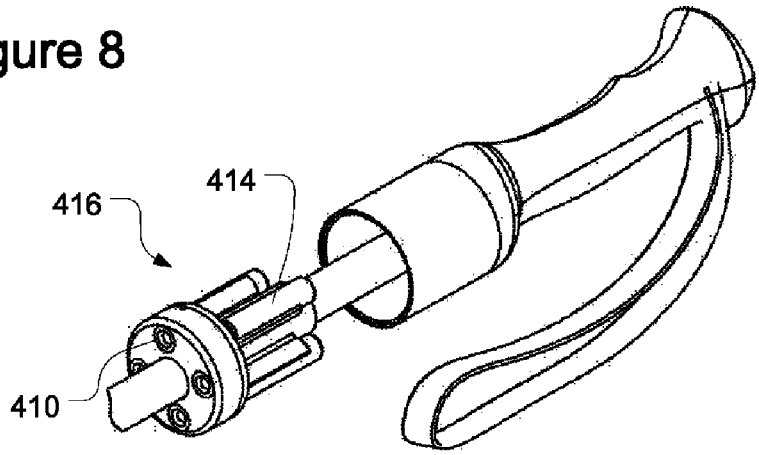
FIG. 10 is a partial perspective view of the handle shown in FIG. 8.
Figure 11:
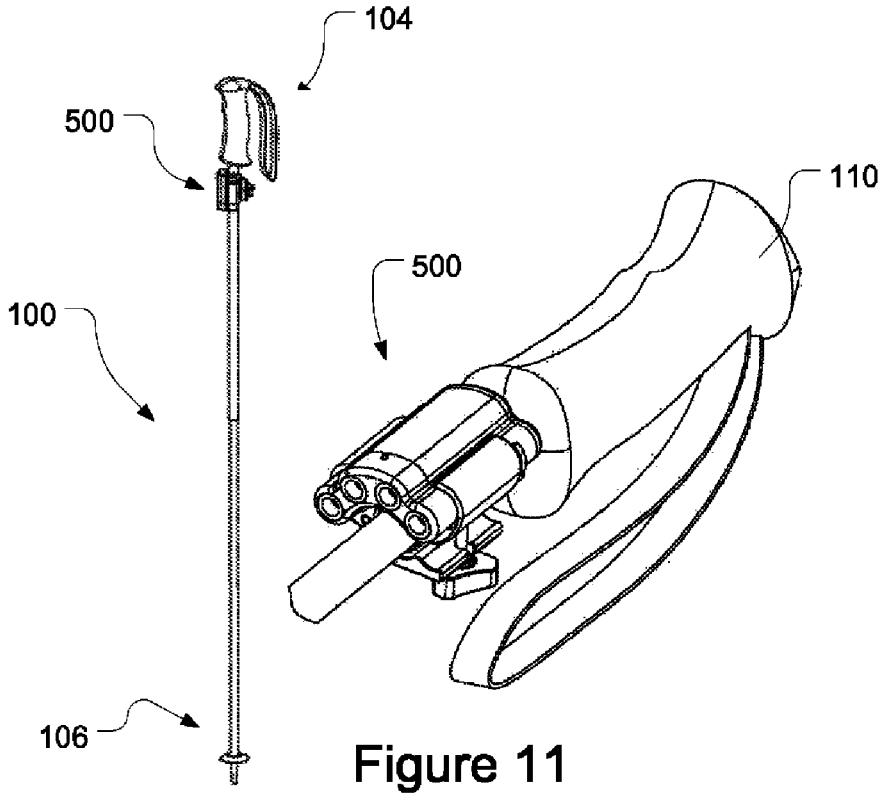
FIG. 11 is a perspective view of another embodiment of a light source for a use with an apparatus for assisting movement, such as the apparatus for assisting movement shown in FIG. 1.
Figure 12:
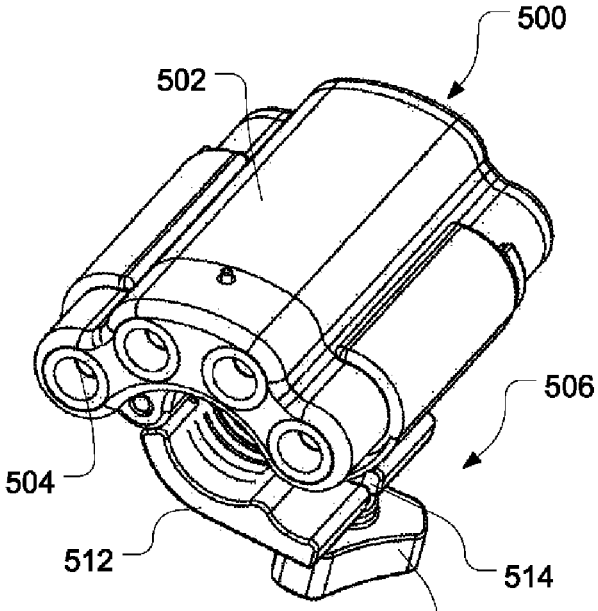
FIG. 12 is a front perspective view of the light source shown in FIG. 11.
Figure 13:
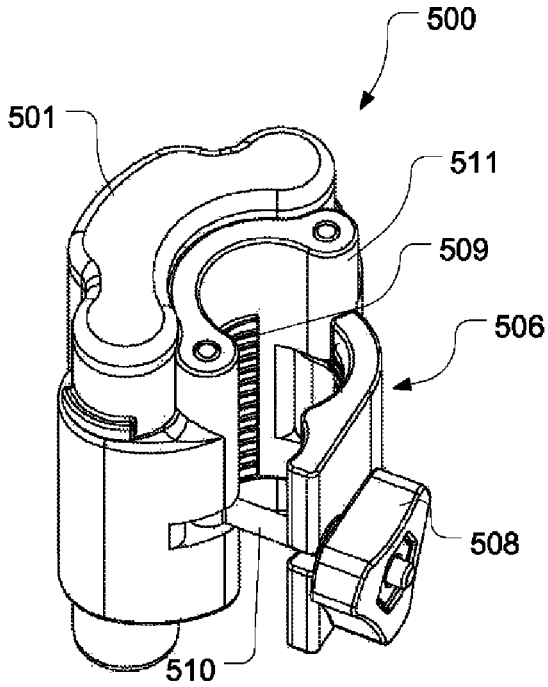
FIG. 13 is a back perspective view of the light source shown in FIG. 11.

In yet another embodiment shown in FIGS. 8-10, a handle 400 may be mounted to a pole, such as pole 102. The handle 400 may include a first end 402 and a second end 404. The first end 402 of the handle 400 may be oriented toward the first end 104 of the pole and the second end 404 of the handle 400 may be oriented toward the second end 106 of the pole 102. The handle 400 may be oriented generally along the elongated shaft of the pole, in a direction parallel to a longitudinal axis of the generally elongated shaft, and in a generally vertical direction. In an alternate embodiment, the handle 400 may be oriented in a direction perpendicular to the generally elongated shaft. The second end 404 of the handle 400 houses a power source 414, contacts 422, a light source 410, a light source lens 426, a light switch 428 and a circuit board 424.

The contacts 422 allow for current to run up one power source, across the contact 422, and back down the adjacent power source 414.

Referring to FIG. 10, the handle 400 may include an internal canister 416 toward the second end 404, which may be cylindrical or any other suitable shape. The canister 416 may be removeably connected to the first end 402 of the handle 400 at portion 406. The canister 416 may be unlocked from its closed position and slid down the pole to provide access for replacing the power source 414. Once the power source 414 has been replaced, the canister 416 may be slid back up the pole and locked back into the handle 400. The canister 416 may be secured to the handle 400 by any suitable fastening mechanism.

The second end 404 of the handle 400 may include at least one light source 410, which may be a light emitting diode (LED). Alternatively, the light source may be any other suitable light source, such as incandescent or fluorescent, for example. In other embodiments, four light sources are included on the handle 400. The light source 410 may project downwardly toward the ground, floor, or surface upon which a person would walk, hike, climb, or ski. Pressing on the light switch allows the user to toggle the light between different modes for different lighting conditions, including levels for low, medium, and high brightness, as well as a strobe setting, which are all settings that may be integrated into the circuit board 424. Alternatively, the light switch may be mounted near the first end 402 of the handle so that a user may operate the switch with a forefinger or thumb while gripping the handle 400.

Referring now to FIGS. 11-14, another embodiment of a light source is disclosed. In this embodiment, a detachable light source 500 may be removeably attached to a hiking pole, cane or other walking aid, such as walking aid 100. Thus, the detachable light source 500 may be removed from the walking aid, if desired, and held in the hand of a user and used as a flashlight, hung or placed on a surface to serve as a lantern, or mounted to any other object.

The detachable light source 500 may be secured to the pole 102 of the walking aid 100, preferably near the first end 104 of the walking aid 100. Positioning the detachable light source near the first end 104 reduces the cantilevered weight effect caused by having the device mounted lower on the pole 102 towards end 106. The higher mounting position also reduces the user's fatigue in carrying a light source as extra weight on a hiking pole. Alternatively, the detachable light source 500 may be secured to any area of the pole 102. The detachable light source 500 may also be removed from the pole.

The example detachable light source 500 may include housing 502 configured to accommodate at least one light source 504. The at least one light source 504 may be a light emitting diode (LED). Alternatively, the light source 504 may be any other suitable light source, such as incandescent or fluorescent, for example. The housing 502 may further comprise a clam shell closure or other clamping mechanism 506 which allows the detachable light source 500 to be attached to poles of varying diameters or having non-symmetrical cross sections. In one example, the clamping mechanism 506 may be removeably connected to the housing 502 so the detachable light source 500 may be removed from the clamping mechanism. Alternatively, the clamping mechanism 506 may be molded directly into the housing 502.

The clamping mechanism 506 may include a first portion 511 and a second portion 512. The clamping mechanism may further include an adjustment knob 508 having an outwardly extending member 510 connected to the first portion 511. The knob 508 may be turned either clockwise or counterclockwise to tighten or loosen the detachable light source 500 from the pole 102. The second portion 512 may include an aperture 514 for accommodating the outwardly extending member 510 of the knob 508. Soft gripping surfaces 509 may be mounted to the inside surfaces of the first and second portions 511, 512 to ensure that the light source 500 stays in place on the pole 100.

Figure 14:
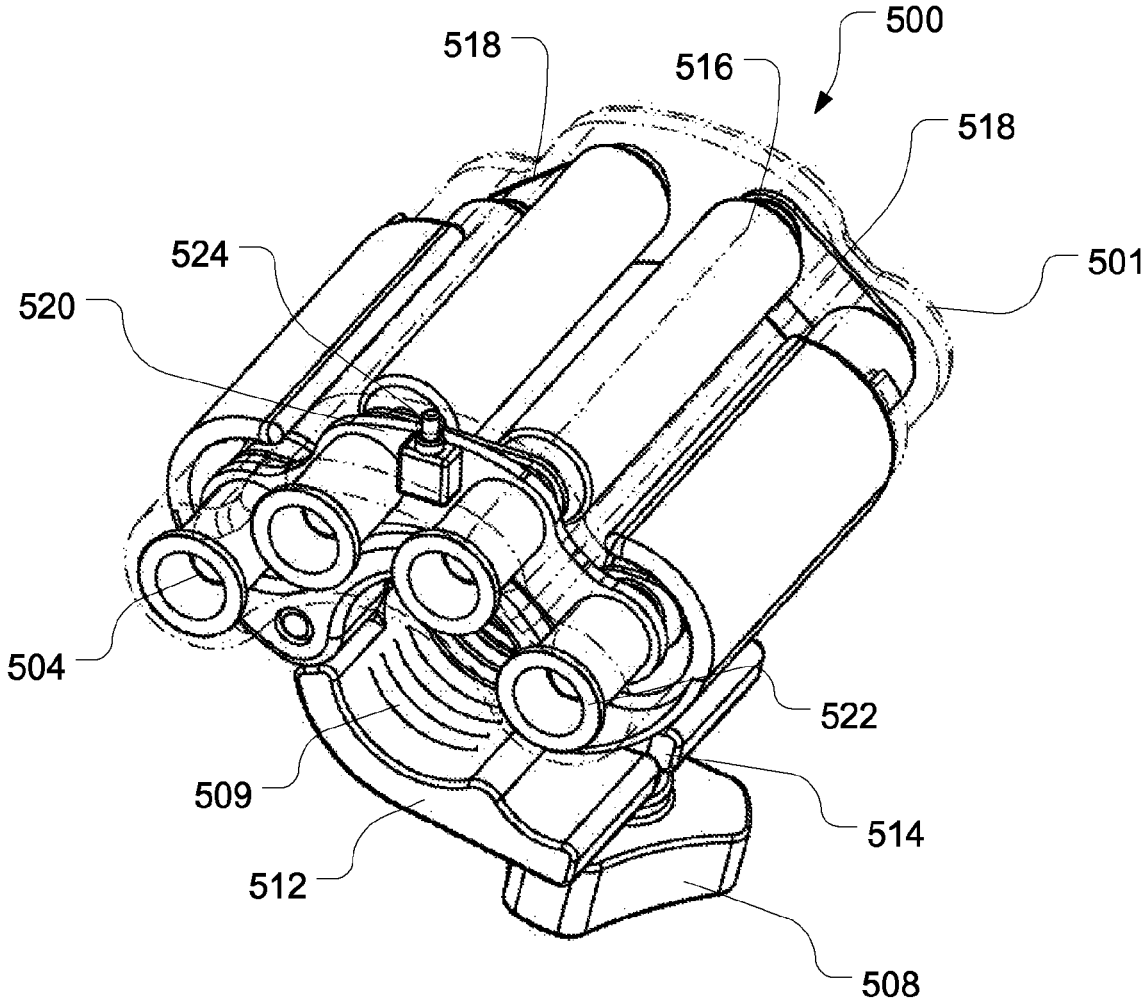
FIG. 14 is a perspective view of the inside of the light source shown in FIG. 11.

The sealed housing 502 protects all of the illuminator's components, including power sources and electronics. As shown in FIG. 14, the housing 502 may include at least one power source 516 mounted inside of the housing 502. The housing 502 may further include a removable portion 501 that may snap on and off of the detachable light source 500 for replacement of the power source 516. The removable portion 501 may be attached to the first end by a hinge, strap, or other suitable means (not shown), for example. The power source 516 may be positioned parallel to the shaft of the pole 102. In one embodiment, the power source 516 may include four AAA batteries. In another embodiment, the power source 516 may include one or more rechargeable batteries. Alternatively, the power source may be any suitable energy generating device. The housing 502 may be designed to be separable from the clamping mechanism 506 which holds the entire device securely onto the pole 102.

At least one power source contact 518 may be mounted to the removable portion 501, thereby allowing electrical current to be passed up one power source and down the next without the need for separate wiring to be run from the top of the device down to a circuit board 520. Physical wires (not shown) may run from the at least one power source contact 518 to the circuit board 520. All remaining wiring takes place in the form of a circuit built into the circuit board 520 itself.

The at least one light source 504 is mounted directly to the circuit board 520, and when illuminated, light passes from the light source 504 through its associated lens 522. The detachable light source 500 may further include a light switch 524, which may be mounted anywhere on the housing 502. Pressing on the light switch 524 allows the user to toggle the light source 504 between different modes for different lighting conditions, including levels for low, medium, and high brightness, as well as a strobe setting, as described above.

In operation, the detachable light source 500 may be secured to the pole 102 by removing the outwardly extending member 510 from the aperture 514 in the back plate 512. The housing may then be positioned around the pole 102, and the outwardly extending member 510 may be placed back within the aperture 514 in the back plate 512. The knob 508 may then be turned to tighten the detachable light source 500 securely onto the pole 102. The soft gripping surfaces 509 ensure that the detachable light source 500 remains in place on pole 100. The detachable light source 500 may be mounted onto the pole 102 so that the light source 504 points in a downward direction toward the floor or ground. Alternatively, the detachable light source 500 may be mounted onto the pole 102 so that the light source 504 points in any direction, if desired.

Figure 15:
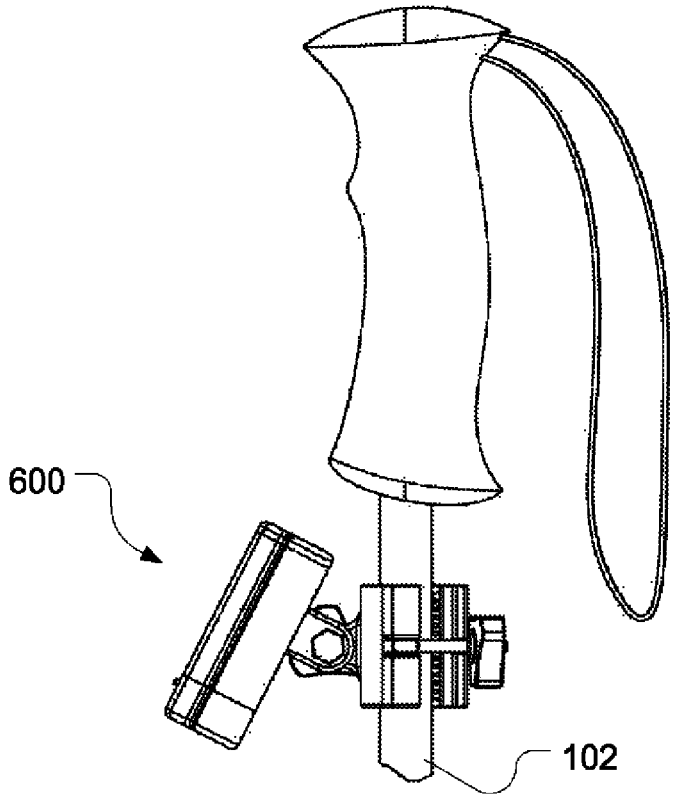
FIG. 15 is a perspective view of yet another embodiment of a light source for a use with an apparatus for assisting movement, such as the apparatus for assisting movement shown in FIG. 1.
Figure 16:
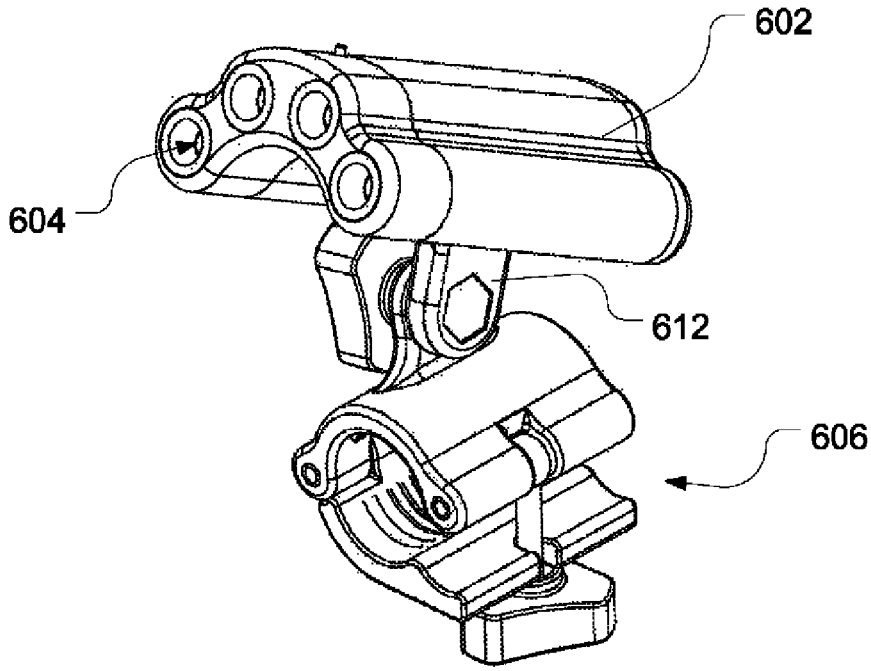
FIG. 16 is a close up view of the light source shown in FIG. 15.
Figure 17:
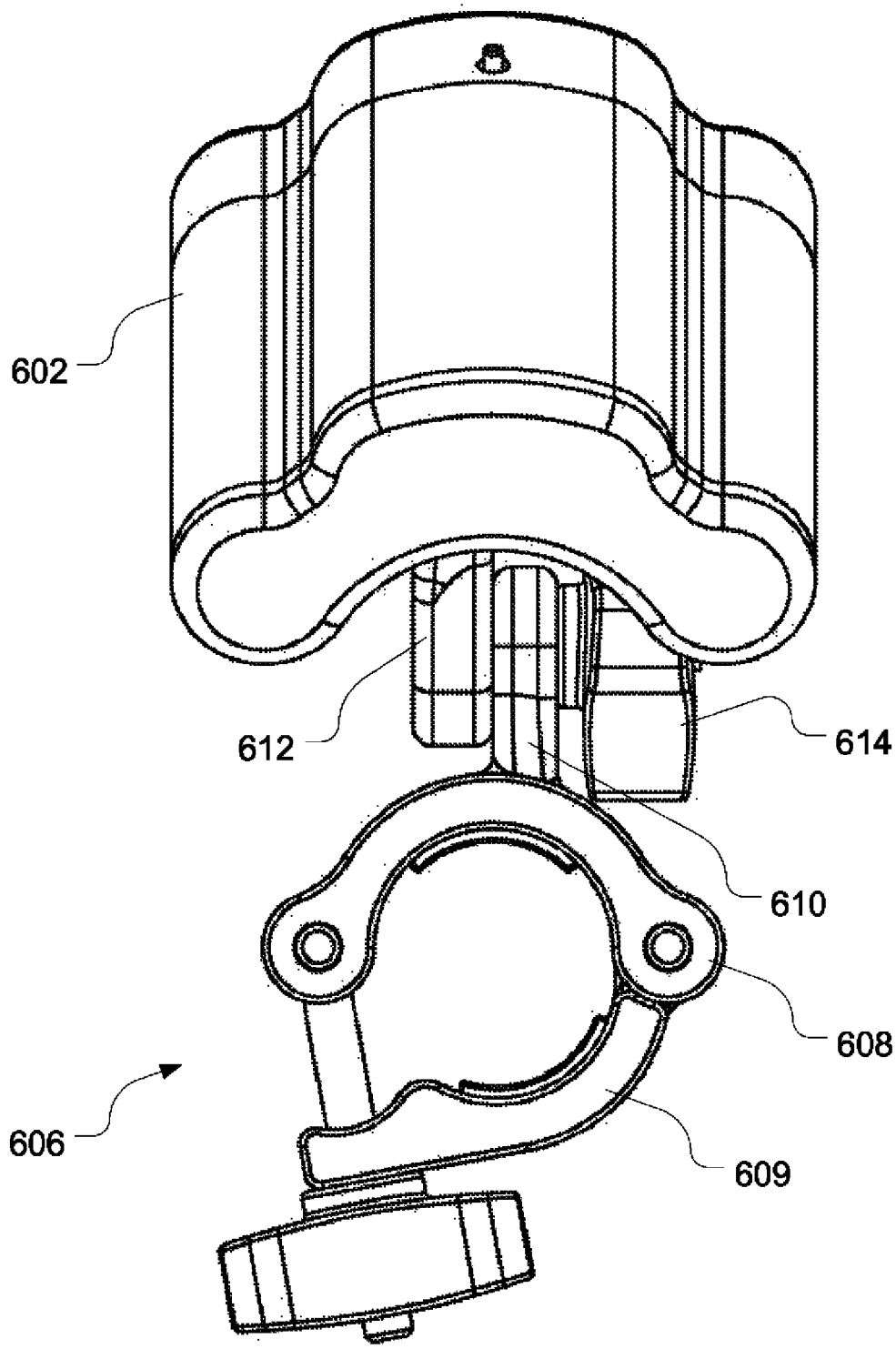
FIG. 17 is a close up view of the light source shown in FIG. 15.

In yet another embodiment of a detachable light source shown in FIGS. 15-17, a detachable light source 600 may include a directionally controlled light source. The detachable light source 600 may be attached to a hiking pole, cane or other walking aid, such as walking aid 100. The detachable light source 600 may be secured to the pole 102 of the walking aid 100, preferably near the first end 104 of the walking aid 100. Alternatively, the detachable light source 600 may be secured to any area of the pole 102.

The example detachable light source 600 may include a housing 602 configured to accommodate at least one light source 604. The at least one light source 604 may be a light emitting diode (LED). Alternatively, the light source 604 may be any other suitable light source, such as incandescent or fluorescent, for example. The housing 602 may further comprise a clam shell closure or other clamping mechanism 606 similar to the clamping mechanism 506 described above with respect to the detachable light source 500. The clamping mechanism 606 of the detachable light source 600 may include a first portion 608 and a second portion 609. The first portion 608 may include an outwardly extending arm 610. The outwardly extending arm 610 may be secured to a corresponding extending arm 612 of the housing 602. The internal electronics for this embodiment are substantially the same as described above with respect to the detachable light source 500.

In operation, a user may adjust the angle and direction of the light source 600 by unlocking the knob 614. The detachable light 600 may then be tilted either forwards or backwards to provide for lighting further in front of the user, or to provide light to someone who is walking, hiking, skiing, etc behind the user. When the desired position of the light is obtained, the user may lock the detachable light source 600 in place by tightening the knob 614. The detachable light source 600 may be secured to the pole 102 in the same manner as described above with respect to detachable light source 500.

Additional features of the present invention include, but are not limited to, convenience, ease of use, ergonomics, sturdiness, reliability, portability and efficiency.

While the application has been described in connection with certain embodiments, it will be understood that it is not intended to limit the invention to those particular embodiments. On the contrary, it is intended to cover all alternatives, modifications, and equivalents included within the spirit and scope of the invention as defined by the appended claims.

We claim:

1. An apparatus for assisting movement comprising:

a generally elongated shaft having a longitudinal axis, the generally elongated shaft including a first end on which a handle is disposed, and a second end for contacting a walking surface, the handle having a longitudinal axis that extends generally in the same direction as the longitudinal axis of the generally elongated shaft;

the handle having a first end and a second end, the first end having a removable portion;

a plurality of light sources located adjacent to the second end of the handle and oriented around the longitudinal axis of the generally elongated shaft; and at least one power source located within the handle for powering the plurality of light sources.

2. The apparatus for assisting movement of claim 1 wherein the second end of the handle is closer to the second end of the generally elongated shaft than the first end of the handle.

3. The apparatus for assisting movement of claim 1 wherein the removable portion is attached to the first end of the handle by a hinge.

4. The apparatus for assisting movement of claim 1 wherein the at least one power source is located at the first end of the handle.

5. The apparatus for assisting movement of claim 1 wherein the at least one power source is located at the second end of the handle.

6. The apparatus for assisting movement of claim 1 wherein the at least one power source is disposed perpendicular to the orientation of the handle along the generally elongated shaft.

7. The apparatus for assisting movement of claim 1 wherein the at least one power source is disposed parallel to the orientation of the handle along the generally elongated shaft.

8. The apparatus for assisting movement of claim 1 wherein the at least one power source includes at least one battery.

9. The apparatus for assisting movement of claim 1 wherein the at least one power source includes at least one rechargeable battery.

10. The apparatus for assisting movement of claim 1 wherein the plurality of light sources project generally downwardly when the generally elongated shaft of the apparatus for assisting movement is oriented generally vertically.

11. The apparatus for assisting movement of claim 1 wherein the plurality of light sources are light emitting diodes (LEDs).

12. The apparatus for assisting movement of claim 1 wherein the apparatus for assisting movement is one of a hiking pole, a ski pole, a cane, or a walker.

13. The apparatus for assisting movement of claim 1 wherein the longitudinal axis of the handle extends in a direction slightly offset from the longitudinal axis of the generally elongated shaft.

14. The apparatus for assisting movement of claim 1 wherein the plurality of light sources are oriented to illuminate along an axis generally in the same direction as the longitudinal axis of the generally elongated shaft.

* * * * *